US012258682B2

(12) United States Patent
Wang et al.

(10) Patent No.: US 12,258,682 B2
(45) Date of Patent: Mar. 25, 2025

(54) MAGNETIC FIBER MATERIAL, PREPARATION METHOD FOR SAME, AND APPLICATIONS THEREOF

(71) Applicant: SOUTH CHINA UNIVERSITY OF TECHNOLOGY, Guangzhou (CN)

(72) Inventors: Linge Wang, Guangzhou (CN); Yifan Jia, Guangzhou (CN); Qianqian Yu, Guangzhou (CN); Yang Wu, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 176 days.

(21) Appl. No.: 17/784,968

(22) PCT Filed: Oct. 20, 2020

(86) PCT No.: PCT/CN2020/122097
§ 371 (c)(1),
(2) Date: Jun. 13, 2022

(87) PCT Pub. No.: WO2021/139306
PCT Pub. Date: Jul. 15, 2021

(65) Prior Publication Data

US 2023/0011363 A1 Jan. 12, 2023

(30) Foreign Application Priority Data

Jan. 10, 2020 (CN) ..... 202010025304.9

(51) Int. Cl.
*D01D 5/00* (2006.01)
*D01D 1/02* (2006.01)
(Continued)

(52) U.S. Cl.
CPC ..... *D01D 5/0046* (2013.01); *D01D 1/02* (2013.01); *D01F 8/04* (2013.01); *D01F 1/10* (2013.01);
(Continued)

(58) Field of Classification Search
CPC ... D01F 1/10; D01F 11/00; D01F 8/04; D01F 6/92; D01F 6/44; D01F 6/50; D01F 6/94; D01D 1/02; D01D 5/0046
(Continued)

(56) References Cited

FOREIGN PATENT DOCUMENTS

CN 1715463 A 1/2006
CN 102336920 A 2/2012
(Continued)

OTHER PUBLICATIONS

Wang et al., CN106620894A, published May 10, 2017, machine translation to English. (Year: 2017).*
(Continued)

*Primary Examiner* — Galen H Hauth
*Assistant Examiner* — Lawrence D. Hohenbrink, Jr.
(74) *Attorney, Agent, or Firm* — Steven M. Koehler; Westman, Champlin & Koehler, P.A.

(57) ABSTRACT

The present invention belongs to the field of functional fibrous materials, and discloses a magnetic fibrous material and a preparation method and application thereof. A polymer and a magnetic load raw material are dissolved in a solvent to obtain a uniform spinning solution; a solute component that reacts with the magnetic load raw material is added into a coagulation bath solvent to obtain a reactive coagulation bath solution; the spinning solution is electrospun, and the produced fiber is collected with the reactive coagulation bath solution, so that the magnetic load raw material in the fiber reacts in situ with the solute in the reactive coagulation bath solution to obtain the magnetic fibrous material.

8 Claims, 3 Drawing Sheets

(51) Int. Cl.

| | |
|---|---|
| ***D01F 8/04*** | (2006.01) |
| *D01F 1/10* | (2006.01) |
| *D01F 6/44* | (2006.01) |
| *D01F 6/50* | (2006.01) |
| *D01F 6/92* | (2006.01) |
| *D01F 6/94* | (2006.01) |
| *D01F 11/00* | (2006.01) |

(52) U.S. Cl.
CPC ..... *D01F 6/44* (2013.01); *D01F 6/50* (2013.01); *D01F 6/92* (2013.01); *D01F 6/94* (2013.01); *D01F 11/00* (2013.01)

(58) Field of Classification Search
USPC ..... 264/465
See application file for complete search history.

(56) References Cited

FOREIGN PATENT DOCUMENTS

| | | | | | |
|---|---|---|---|---|---|
| CN | 102978730 | A | | 3/2013 | |
| CN | 104032403 | A | | 9/2014 | |
| CN | 105801901 | A | | 7/2016 | |
| CN | 106620894 | A | * | 5/2017 | ..... A61L 31/128 |
| CN | 106637507 | A | | 5/2017 | |
| CN | 106987922 | A | | 7/2017 | |
| CN | 107354520 | A | | 11/2017 | |
| CN | 106987922 | B | * | 2/2019 | ..... D01F 2/02 |
| CN | 109735962 | A | | 5/2019 | |
| CN | 111155197 | A | | 5/2020 | |
| KR | 101909495 | B1 | | 10/2018 | |

OTHER PUBLICATIONS

Zhang et al., CN106987922 B, published Feb. 26, 2019, machine translation to English (Year: 2019).*

International Search Report and Written Opinion in corresponding International Application No. PCT/CN2020/122097 dated Jan. 26, 2021.

Peng et al. "Nanocomplex Based on Biocompatible Phospholipids and Albumin for Long-Circulation Applications", ACS Applied Materials & Interfaces, Jul. 24, 2014, pp. 13730-13737, vol. 6, No. 16.

* cited by examiner

MAGNETIC FIBER MATERIAL, PREPARATION METHOD FOR SAME, AND APPLICATIONS THEREOF

CROSS-REFERENCE TO RELATED APPLICATION(S)

This Application is a Section 371 National Stage Application of International Application No. PCT/CN2020/122097, filed Oct. 20, 2020 and published as WO 2021/139306 A1 on Jul. 15, 2021, and further claims priority to Chinese Application Ser. No. 202010025304.9, filed Jan. 10, 2020.

FIELD OF THE INVENTION

The present invention belongs to the field of functional fibrous materials, and specifically relates to a magnetic fibrous material and a preparation method and application thereof.

BACKGROUND OF THE INVENTION

With the development and progress of magnetic materials, they have become an important basic material for the national economy and human society. After being subjected to an external magnetic field, a substance can induce a magnetic field related to the external magnetic field. The direction of the induced magnetic field (with an intensity called. magnetic field intensity M) is parallel to that of the external magnetic field (with an intensity called magnetization H). X=M/N is usually used to measure the magnetic properties of the substance.

According to the value and positive/negative sign of z and the change of x under different H, substances can be roughly divided into diamagnetic materials, paramagnetic materials, ferromagnetic materials, antiferromagnetic materials, ferrimagnetic materials, and superparamagnetic materials. Among them, paramagnetic materials and superpararnagnetic materials have been applied to microwave amplifiers, nuclear magnetic resonance imaging technology, electronic paramagnetic resonance imaging technology, biological oxygen test (oxygen meters) and so on based on their unique properties. However, due to the restriction of modern theories, excellent magnetic materials must be prepared with metal elements. Therefore, for a long time, the magnetic properties of materials can only be imparted by inorganic substances or organic-inorganic compounds.

With the wide applications of magnetic materials, flexible magnetic materials gradually become necessary to actual production and life. Loading flexible materials with magnetic inorganic materials for preparing composite materials is a feasible way to endow magnetic materials with flexibility. However, in this loading process, the morphology of the inorganic materials and their distribution in the flexible materials are important parameters affecting the performance and application of these composite materials. The properties of the materials, especially the paramagnetic and superparamagnetic materials, will change dramatically when their size is reduced to is nanoscale, and small changes in their size and morphology will greatly affect their magnetic properties.

Fibers can often exhibit excellent flexibility due to their extremely large aspect ratio. Electrospinning technology can be used to continuously produce polymer fibers with a diameter of submicron or even nanometer level, which have a controllable diameter and a large specific surface area and exhibit good functional characteristics. Besides, the electrospinning technology has been extensively studied for many years because of its advantages such as simple experimental device, lower cost, higher yield and easy control. Compared with the traditional spinning method, the electrospinning technology does not require a filtration device before spinneret, so it allows the addition of insoluble or poorly soluble components to the spinning solution, and is thus an excellent means for preparing organic/inorganic flexible composite materials. However, first, most magnetic particles are difficult to dissolve in organic (polymer) solutions; second, particles of small size (such as nanoscale) tend to agglomerate into large particles in the spinning process because of their higher surface energy; third the magnetic materials attract each other and are easy to agglomerate.The existence of these phenomenon lead to agglomeration of the magnetic materials originally dispersed in the solution after the electrospinning. In particular, paramagnetic and superparamagnetic materials are more sensitive to the size of the materials, and small changes in size will bring about huge changes in magnetic properties. For the current technology, in the process of electrospinning, the solvent quickly volatilizes from the solution to achieve the solidification of the fiber. However, after the spinning, the electrospun fiber is still wet (i.e. there is residual solvent). Although the fibrous material has precipitated from the solution at this time, the presence of the residual solvent can still make the fiber material and the materials to loaded within the fiber get sufficient mobility to cause agglomeration of small-sized particles, so that smaller-sized magnetic materials cannot be obtained, Therefore, the technical problem to be solved by the present invention is how to obtain smaller-sized (nano, sub-nano, molecular, atomic) magnetic materials in electrospinning magnetic fibrous materials, so as to improve the magnetic properties of the materials.

SUMMARY OF THE INVENTION

In view of the above shortcomings and deficiencies of the prior art, the primary object of the present invention is to provide a method for preparing magnetic fibrous materials. The present invention provides a method for in-situ synthesis of magnetic materials by electrospinning, so that the magnetic materials can be dispersed at the monomolecular (or mooatornic) level in fibers obtained by electrospinning, so as to obtain better magnetic properties. Meanwhile, the flexibility, high porosity, and high specific surface area of the materials brought: by the fiber are maintained.

Another object of the present invention is to provide a magnetic fibrous material prepared by the above method.

Still another object of the present invention is to provide the application of the above-mentioned magnetic fibrous materials in magnetic resonance imaging materials, magnetic recording materials, magnetic cooling materials, magnetostrictive materials, magnetoluminescent materials.

The objects of the present invention are achieved through the following technical solution:

A method for preparing magnetic fibrous materials is provided, comprising the following preparation steps:

(1) preparation of spinning solution: dissolving a polymer and a magnetic load raw material in a solvent to form a uniform spinning solution;

(2) preparation of reactive coagulation bath solution: adding a solute component that reacts with the magnetic load raw material into a coagulation bath solvent to form a uniform reactive coagulation bath solution; and (3) electrospinning the spinning solution obtained in step (1), and collecting the produced fiber with the reactive coagulation bath solution obtained in step (2), so that the magnetic load raw material in the fiber reacts in situ with the solute in the reactive coagulation bath solution to obtain the magnetic fibrous material.

Further, the polymer in step (1) is at least one of the following substances: polylactic acid, polycaprolactone, polyglycolide, polylactide, polyglycolic acid, hyaluronic acid, fibrin, silk protein, polyethylene glycol, chitosan, collagen, gelatin, polyethylene, polypropylene, polyvinyl chloride, polystyrene, polymethyl methacrylate, polyamide, polycarbonate, polyoxymethylene, polybutylene terephthalate, polyethylene terephthalate, cellulose acetate, methyl cellulose, ethyl cellulose, hydroxyethyl cellulose, cyanoethyl cellulose, hydroxypropyl cellulose, hydroxypropyl methyl cellulose, hydroxyethyl starch, carboxymethyl starch, polyvinylpyrrolidone, polyvinyl alcohol, polyacrylonitrile, polyethylene glycol-polylactic acid block copolymer, polyethylene glycol-polycaprolactone block copolymer, polyethylene glycol-polyvinylpyrrolidone block copolymer, polystyrene-polybutadiene block copolymer, styrene-butadiene-styrene triblock copolymer, polystyrene-pope(ethylene-butylene)-polystyrene block copolymer, styrene-isoprene/butadiene-styrene block copolymer, and polystyrene-polybutadiene-polystyrene block copolymer. The mass fraction of the polymer in the spinning solution is 1% to 40%.

Further, the magnetic load raw material in step (1) is a simple substance, an alloy or a compound; the simple substance is at least one of iron, nickel, manganese, copper, and lanthanide metals; the alloy is at least one of ferrosilicon alloy, iron-nickel alloy, iron-silicon aluminum alloy, aluminum-nickel-cobalt alloy, iron-chromium-cobalt alloy, ferrite, manganese-zinc alloy, nickel-zinc alloy, neodymium-iron-boron alloy, and iron-lanthanide metal alloy; the compound is at least one of the chloride, oxide, nitrate and sulfate of iron, nickel, aluminum, manganese, copper and lanthanide metals; and the amount of the magnetic load raw material added is 0.001% to 10% by mass of that of the polymer.

Further, the solvent in step (1) is one or a mixture of two or more of the following substances: water, dichloromethane, chloroform, dichloroethane, tetrachloroethane, methyl acrylate, tetrahydrofuran, methyltetrahydrofuran, N,N-dimethylformamide, N,N-dimethylacetamide, dimethyl sulfoxid.e, ether, petroleum ether, acetone, formic acid, acetic acid, trifluoroacetic acid, carbon tetrachloride, xylene, toluene, phenol, chlorobenzene, nitrobenzene, pentane, n-hexane, methylcyclohexane, N-methylpyrrolidone, anisole, methanol, ethanol, is 1-propanol, 2-propanol, 1-butanol, 2-butanol, pentanol, N-methylmorpholine-N-oxide, methylimidazole chloride, and cresol.

Further, the coagulation bath solvent in step is one or a mixture of two or more of the following substances: water, dichloromethane, chloroform, dichloroethane, tetrachloroethane, methyl acrylate, tetrahydrofuran, methyltetrahydrofuran, N,N-dimethylformamide, N,N-dimethylacetamide, dimethyl sulfoxide, ether, petroleum ether, acetone, formic acid, acetic acid, trifluoroacetic acid, carbon tetrachloride, xylene, toluene, phenol, chlorobenzene, nitrobenzene, pentane, n-hexane, methylcyclohexane, N-methylpyrrolidone, anisole, methanol, ethanol, 1-propanol, 2-propanol, 1-butanol, 2-butanol, pentanol, N-methylmorpholine-N-oxide, methyl imidazole chloride, and cresol.

Further, when the solvent in step (1) is water, preferably, the coagulation bath solvent in step (2) can be one or a mixture of two or more of N,N-dimethylformamide, N,N-dimethylacetamide, dimethyl sulfoxide, ether, petroleum ether and acetone; when the solvent in step (1) is one or a mixture of two or more of dichloromethane, chloroform, dichloroethane and tetrachloroethane, preferably, the coagulation bath solvent in step (2) can be one or a mixture of two or more of water, xylene, toluene, phenol, chlorobenzene, nitrobenzene, pentane, n-hexane, methylcyclohexane, N-methylpyrrolidone and anisole; when the solvent in step (1) is one or a mixture of two or more of methyl acrylate, tetrahydrofuran, methyltetrahydrofuran, N,N-dimethylformamide, N,N-dimethylacetamide, dimethyl sulfoxide, ether, petroleum ether and acetone, preferably, the coagulation bath solvent in step (2) can be one or a mixture of two or more of water, formic acid, acetic acid, trifluoroacetic acid, carbon tetrachloride, N-methylpyrrolidone, anisole, methanol, ethanol, 1-propanol, 2-propanol, 1-butanol, 2-butanol, pentanol, N-methylmorpholine-N-oxide, rnethylimidazole chloride and cresol; when the solvent in step (1) is one or a mixture of two or more of formic acid, acetic acid, trifluoroacetic acid, carbon tetrachloride, methanol, ethanol, 1-propanol, 2-propanol, 1-butanol, 2-butanol, pentanol, N-methylmorpholine-N-oxide, methylimidazole chloride and cresol, preferably, the coagulation bath solvent in step (2) can be one or a mixture of two or more of water, is dichloromethane, chloroform, dichloroethane, tetrachloroethane, methyl acrylate, tetrahydrofuran, methyltetrahydrofuran, N,N-dimethylformamide, N,N-dimethylacetamide, dimethyl sulfoxide, ether, petroleum ether and acetone.

Further, the solute component in step (2) is at least one of the hydroxides of lithium, sodium, magnesium, aluminum, potassium and calcium, or at least one of the carbonates of lithium, sodium, potassium and ammonium, or at least one of the phosphates of lithium, sodium, magnesium, potassium and ammonium, Further, when the magnetic load raw material in step (1) is a mixture of one of simple iron, nickel, copper and lanthanide metals, and one of the chloride, sulfate and nitrate of iron, nickel, copper and lanthanide metals, preferably, the solute in step (2) is one or a mixture of two or more of the hydroxide and carbonate of lithium, sodium and potassium; when the magnetic load raw material in step (1) is a mixture of one of ferrosilicon alloy, iron-nickel alloy, iron-silicon-aluminum alloy, aluminum-nickel-cobalt alloy and iron-chromium-cobalt alloy, and one of the chloride, sulfate and nitrate of iron, nickel, copper and lanthanide metals, preferably, the solute in step (2) is one or a mixture of two or more of the chloride and hydroxide of lithium, sodium, magnesium, aluminum, potassium and calcium; when the magnetic load raw material in step (1) is one or a mixture of two or more of ferrite, zinc-manganese alloy, neodymium-iron-boron alloy and iron-lanthanide metal alloy, preferably, the solute in step (2) is one or a mixture of two or more of the carbonate and hydroxide of lithium, sodium and ammonium; when the magnetic load raw material in step (1) is one or a mixture of two or more of the chloride and sulfate of iron, manganese, copper and lanthanide metals, preferably, the solute in step (2) is one or a mixture of two or more of the hydroxide and carbonate of lithium, sodium, magnesium, potassium and calcium.

Further, the conditions for the electrospinning in step (3) are as follows: voltage of the spinneret is 0.5-50 kV (positive or negative), and voltage of the coagulation bath is 0-50 kV (positive or negative, opposite to the spinneret potential, or grounded); the distance between the spinneret and the coagulation bath is 5-50 cm, and the spinning solution supply speed is 0.1-30 mL/h; during the electrospinning, the is ambient temperature is 5° C. to 60° C., and the relative humidity is 25% to 95%.

Further, during the electrospinning in step (3), it is necessary to continuously supplement the coagulation bath to ensure the stability of its component ratio, A magnetic:fibrous material is prepared by the above method.

The above-mentioned magnetic fibrous material is applied to magnetic resonance imaging materials, magnetic recording materials, magnetic cooling materials, magnetostrictive materials or magnetoluminescent materials.

The principle of the technical solution provided by the present invention is as follows; firstly, the high viscosity of the polymer solution and the ability of the solution to dissolve the magnetic load raw material are utilized to maintain the dispersion state of the load raw material in the solution and prevent the agglomeration; then, in the process of electrospinning, the rapid volatilization of the solvent makes the polymer and the magnetic load raw material quickly precipitate out of the solvent and deposit in situ; finally, the coagulation bath is used to swell the fiber, further remove the solvent, and make the solute component of the coagulation bath contact with the magnetic load raw material in the fiber so as to react in situ, thereby producing monomolecular (or monoatomic) dispersed magnetic materials. The reactive coagulation bath has the following functions: (1) the components of the coagulation bath can extract the residual solvent out: of the polymer fiber to accelerate s the solidification of the fiber, and also solidify the magnetic load raw material to prevent its agglomeration; and (2) the solute component of the coagulation bath can react: with the magnetic load raw material, and the reaction can proceed quickly in situ by virtue of the high specific surface area of the fiber to produce the magnetic material. Thus, the problem of agglomeration of the magnetic materials in the spinning solution and the electrospinning process is solved.

The preparation method of the present invention and the obtained product have the following advantages and beneficial effects;

(1) Through the method for preparing magnetic fibrous materials provided by the present invention, no additional nano-material dispersant is needed, the magnetic materials can be produced by the in-situ reaction in the fiber, and the electrospinning process can be completed synchronously with the magnetic material synthesis process.

(2) With the method of the present invention, a simple electrospinning device can be adopted, the obtained fibrous material has complete morphology and no significant defects compared with the fibers prepared by the prior art, and fibrous materials with controllable morphology, diameter and magnetic properties can be prepared according to actual needs.

(3) The method for preparing magnetic fibrous materials provided by the present invention can effectively prevent the agglomeration of the magnetic material, and produce monomolecular (or monoatomic) dispersed flexible magnetic fiber that cannot be obtained by the prior art, with the monomolecular dispersed magnetic material having better magnetic properties,

DETAILED DESCRIPTION OF THE EMBODIMENTS

The present invention will be described in further detail below with reference to examples and drawings, but the embodiments of the present invention are not limited thereto.

EXAMPLE 1

Figure 1:
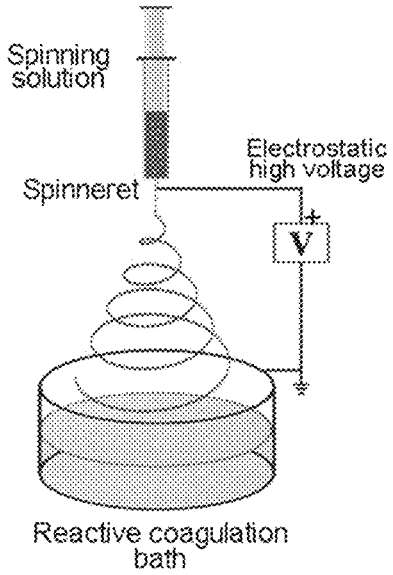
FIG. 1 is a schematic diagram of the reactive coagulation bath electrospinning device used in an example of the present invention.

(1) Dissolving polyethylene terephthalate. and gadolinium chloride hexahydrate in a mixed solvent of dichloromethane and trifluoroacetic acid (with a mass ratio of 1:2) to form a polymer solution with a mass fraction of 15% (in which the amount of gadolinium chloride hexahydrate added was 0.1% by mass of polyethylene terephthalate), thereby obtaining a spinning solution;

(2) adding sodium hydroxide to water to adjust the pH to 9, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of +18 kV, and the coagulation bath was connected to a voltage of −1 kV. The distance between the spinneret and the coagulation bath was 15 cm, and the spinning solution supply speed was 2 mL/h. During the spinning, the ambient temperature was 25° C. and the relative humidity was 65%, and it was necessary to continuously supplement the coagulation bath to ensure its component stability. After the spinning, the reaction continued in the coagulation bath before the fiber was taken out to obtain the final product.

Figure 2:
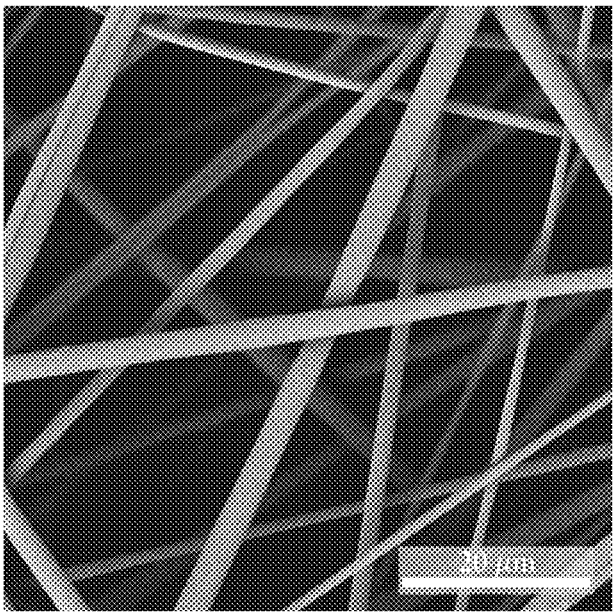
FIG. 2 is a scanning electron micrograph of the magnetic fiber prepared in Example 1 of the present invention.

The scanning electron micrograph of the magnetic fiber prepared in this example is shown in FIG. 2, with the fiber diameter being about 900 nm.

Figure 3:
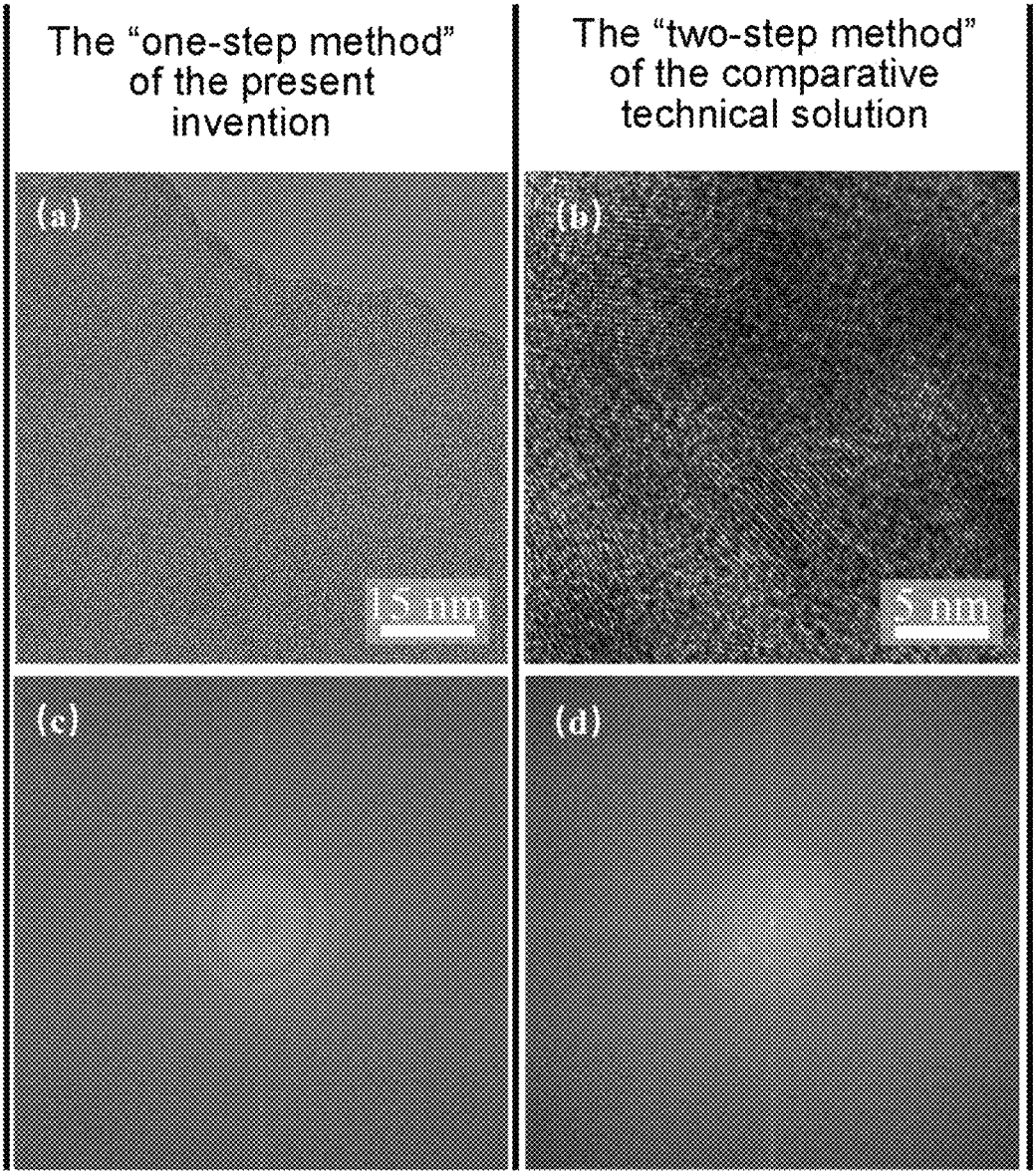
FIG. 3 is a transmission electron micrograph of the magnetic fibers prepared in Example 1 of the present invention (a and c in the figure) and a comparative example (b and d in the figure), showing that the magnetic particles are in a monomolecular dispersion state in the magnetic fiber prepared by the present invention.

FIG. 2 shows the scanning electron micrograph of the magnetic fiber prepared in this example, with the fiber diameter being about 900 nm. FIG. 3(*a, c*) is a transmission electron micrograph of the magnetic fiber prepared in this example, characterizing the state of the magnetic material in the fiber. FIG. 3*a* shows that the magnetic material was not agglomerated in the fiber (the particle spacing was about 0.5 nm), and FIG. 3*c* shows a number of dispersive rings shown as the Fourier transform result, indicating that the magnetic material was monodispersed (the atomic radius of gadolinium atoms is 0.254 nm, see "Rare Earth Elements and Their Analytical Chemistry", Li Mei et al., Chemical Industry Press, 2009), and the magnetic material was in an amorphous state.

EXAMPLE 2

(1) Dissolving polyethylene terephthalate and gadolinium chloride hexahydrate in a mixed solvent of dichloromethane and trifluoroacetic acid (with a mass ratio of 1:2) to form a polymer solution with a mass fraction of 15% (in which the amount of gadolinium chloride hexahydrate added was 0.2% by mass of polyethylene terephthalate), thereby obtaining a spinning solution;

(2) adding sodium hydroxide to water to adjust the pH to 9.2, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of +17 kV, and the coagulation bath was connected to a voltage of −2 kV. The distance between the spinneret and the coagulation bath was 15 cm, and the spinning solution supply speed was 3 mL/h. During the spinning, the ambient temperature was 25° C. and the relative humidity was 65%, and it was necessary to continuously supplement the coagulation bath to ensure its component stability. After the spinning, the reaction continued in the coagulation bath before the fiber was taken out to obtain the final product.

EXAMPLE 3

(1) Dissolving polyethylene terephthalate and gadolinium chloride hexahydrate in a mixed solvent of dichloromethane and trifluoroacetic acid (with a mass ratio of 1:2) to form a polymer solution with a mass fraction of 15% which the amount of gadolinium chloride hexahydrate added was 0.3% by mass of polyethylene terephthalate), thereby obtaining a spinning solution;

(2) adding sodium hydroxide to water to adjust the pH to 9.5, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of +16 kV, and the coagulation bath was connected to a voltage of −3 kV. The distance between the spinneret and the coagulation bath was 15 cm, and the spinning solution supply speed was 3 mL/h. During the spinning, the ambient temperature was 25° C. and the relative humidity was 65%, and it was necessary to continuously supplement the coagulation bath to ensure its component stability. After the spinning, the reaction continued in the coagulation bath before the fiber was taken out to obtain the final product.

EXAMPLE 4

Dissolving polyethylene terephthalate and gadolinium chloride hexahydrate in a mixed solvent of dichloromethane and trifluoroacetic acid (with a mass ratio of 1:2) to form a polymer solution with a mass fraction of 15% (in which the amount of gadolinium chloride hexahydrate added was 0.5% by mass of polyethylene terephthalate), thereby obtaining a spinning solution;

(2) adding sodium hydroxide to water to adjust the pH to 9.7, and mixing uniformly before adding the obtained solution to a coagulation bath container to obtain a reactive coagulation bath solution; and (3) electrospinning the spinning solution obtained in step (1), and collecting is fibers with the reactive coagulation bath solution obtained in step (2), with the schematic diagram of the device used shown in FIG. 1. The spinneret was connected to a voltage of +15 kV, and the coagulation bath was connected to a voltage of −2 kV. The distance between the spinneret and the coagulation bath was 15 cm, and the spinning solution supply speed was 3.5 mL/h. During the spinning, the ambient temperature was 25° C. and the relative humidity was 65%, and it was necessary to continuously supplement the coagulation bath to ensure its component stability. After the spinning, the reaction continued in the coagulation bath before the fiber was taken out to obtain the final product.

Figure 4:
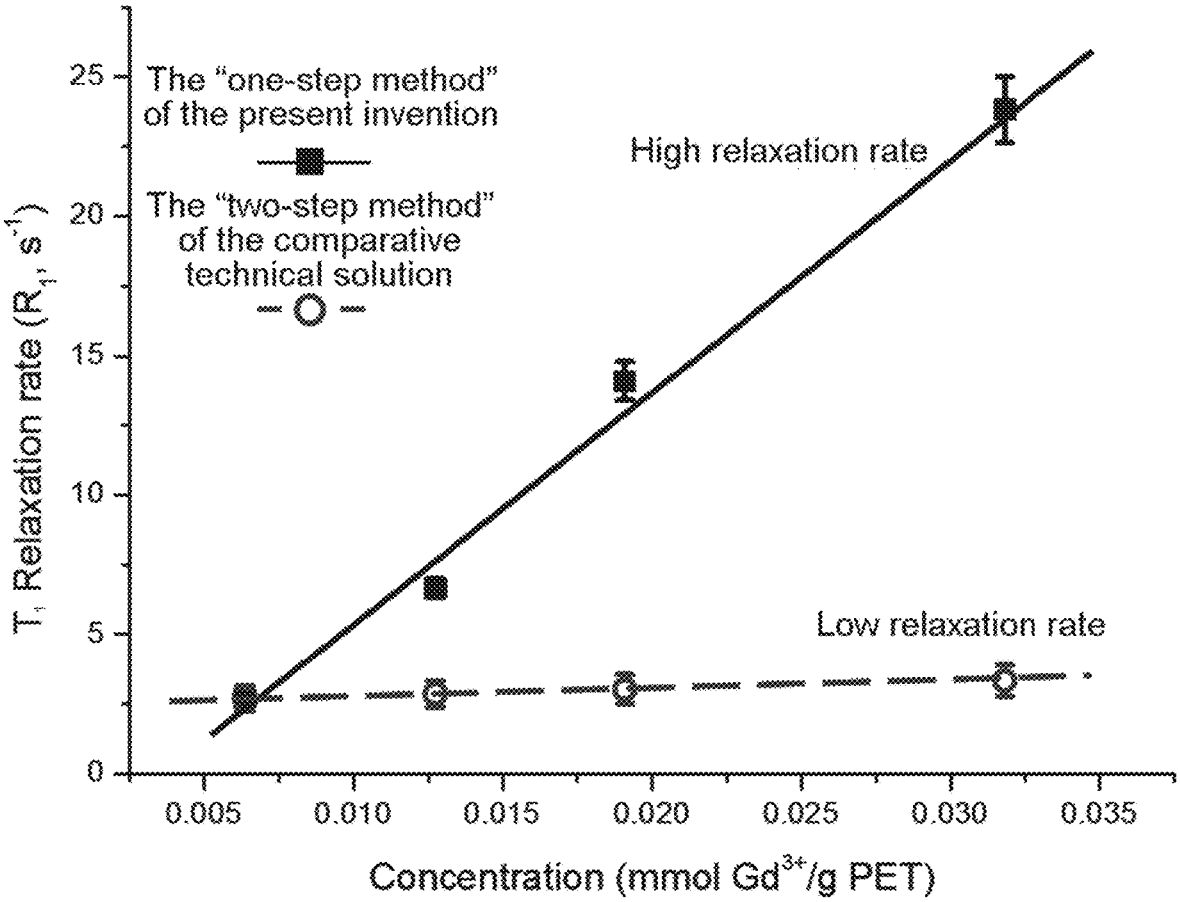
FIG. 4 shows the test results of the magnetic resonance relaxation efficiency of the paramagnetic fibers prepared in Examples 1-4 of the present invention and the comparative example under different concentrations of the magnetic load raw material, indicating that the fiber prepared by the present invention has a significantly higher $T_1$ magnetic resonance relaxation rate and a better magnetic resonance contrast effect than the comparative technical solution.

The test results of the magnetic resonance relaxation rate of the magnetic fibers prepared in Examples 1-4 are shown in FIG. 4 (in which the technical solution of the present invention is shown as a solid square). It can be seen that the technical solution of the present invention had a higher relaxation rate and a better magnetic resonance contrast effect than the technical solution of the comparative example.

EXAMPLE 5

(1) Dissolving an aluminum-nickel-cobalt alloy ($Al_8Ni_{16}Co_{24}Cu_3Fe_{39}$) and ferric chloride nanoparticles (with a mass ratio of 3:1) and polyethylene glycol (with a molecular weight of 500,000) in tetrahydrofuran to form a polymer solution with a mass fraction of 1% (in which the amount of the aluminum-nickel-cobalt alloy and ferric chloride nanoparticles added was 0.0015% by mass of polyethylene glycol), thereby obtaining a spinning solution;

(2) adding sodium hydroxide at a mass concentration of 2% to methanol, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of +30 kV, and the coagulation bath was grounded. The distance between the spinneret and the coagulation bath was 25 cm, and the spinning solution supply speed was 5 mL/h. During the spinning, the ambient temperature was 30° C. and the relative humidity was 50%, and it was necessary to continuously supplement the coagulation bath to ensure its component stability, After the spinning, the reaction continued in the coagulation bath before the fiber was taken out to obtain the final product.

EXAMPLE 6

(1) Dissolving an aluminum-nickel-cobalt alloy ($Al_8Ni_{16}Co_{24}Cu_3Fe_{39}$) and ferric chloride nanoparticles (with a mass ratio of 3:1) and polystyrene in tetrahydrofuran to form a polymer solution with a mass fraction of 1% (in which the amount of the aluminum-nickel-cobalt alloy and ferric chloride nanoparticles added was 0.005% by mass of polystyrene), thereby obtaining a spinning solution;

(2) adding sodium hydroxide at a mass concentration of 1% to methanol, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of +30 kV, and the coagulation bath was connected to a voltage of −20 kV. The distance between the spinneret: and the coagulation bath was 10 cm, and the spinning solution supply speed was 20 mL/h. During the spinning, the ambient temperature was 10° C. and the relative humidity was 30%, and it was necessary to continuously supplement the coagulation bath to ensure its component stability. After the spinning, the reaction continued in the coagulation bath before the fiber was taken out to obtain the final product.

EXAMPLE 7

(1) Dissolving nickel nitrate, ferric nitrate and gadolinium nitrate (with a mass ratio of 1:1:2) and polyvinyl alcohol in a mixed solvent of trifluoroacetic acid and propanol (with a mass ratio of 1:1) to form a polymer solution with a mass fraction of 8% (in which the amount of nickel nitrate, ferric nitrate and gadolinium nitrate added was 5% by mass of polyvinyl alcohol), thereby obtaining a spinning solution;

(2) adding potassium carbonate at a mass concentration of 5% to the mixed solution of water and methanol (with a mass ratio of 3:1), and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret: was connected to a voltage of +15 kV, and the coagulation bath was connected to a voltage of −40 kV. The distance between the spinneret and the coagulation bath was 15 cm, and the spinning solution supply speed was 15 mL/h. During the spinning, the ambient temperature was 10V and the relative humidity was 80%, and it was necessary to continuously supplement: the coagulation bath to ensure its component stability. After the spinning, the reaction continued in the coagulation bath before the fiber was taken out to obtain the final product.

EXAMPLE 8

(1) Dissolving cobalt chloride and europium nitrate (with a mass ratio of 1:4) and a polystyrene-polybutadiene-polystyrene block copolymer in a mixed solvent of tetrahydrofuran and N,N-dimethylformamide (with a mass ratio of 1:1) to form a polymer solution with a mass fraction of 12% (in which the amount of cobalt chloride and europium nitrate added was 0.5% by mass of the polystyrene-polybutadiene-polystyrene block), thereby obtaining a spinning solution;

(2) adding potassium carbonate at a mass concentration of 5% to water, and mixing uniformly before adding the obtained solution to a coagulation bath container to obtain a reactive coagulation bath solution; and (3) electrospinning the spinning solution obtained in step (1), and collecting fibers with the reactive coagulation bath solution obtained in step (2), with the schematic diagram of the device used shown in FIG. 1. The spinneret was connected to a voltage of 50 kV, and the coagulation bath was connected to a voltage of −5 kV. The distance between the spinneret and the coagulation bath was 10 cm, and the spinning solution supply speed was 2.5 mL/h. During the spinning, the ambient temperature was 50° C. and the relative humidity was 25%, and it was necessary to continuously supplement the coagulation bath to ensure its component stability. After the spinning, the reaction continued in the coagulation bath before the fiber was taken out to obtain the final product.

COMPARATIVE EXAMPLE

In order to illustrate the performance advantages of the magnetic fiber obtained by the technology of the present invention, while using the technology of the present invention to prepare the new magnetic fiber, we also adopted another technical solution (comparative technical solution) to prepare a magnetic fiber, and tested and compared the properties of the fibers prepared by the two methods.

The technical solution of the present invention can be summarized as that after the preparation of the spinning solution, the magnetic fiber is obtained in one step through the electrospinning method by using the reactive coagulation bath as the fiber receiving device, thus referred to as a "one-step method" for short. The comparative technical solution can be summarized as that after the preparation of the spinning solution, the fiber is collected by a traditional fiber receiving device (such as a grounded plate), and then transferred to the reaction solution for reaction to generate the magnetic fiber, thus referred to as a "two-step method" for short.

The specific implementation scheme of the "two-step method" is as follows: (1) Dissolving polyethylene terephthalate and gadolinium chloride hexahydrate in a mixed solvent of dichloromethane and trifluoroacetic acid (with a mass ratio of is 1:2) to form a polymer solution with a mass fraction of 1.5% (in which the amount of gadolinium chloride hexahydrate added was respectively 0.1%, 0.2%, 0.3% and 0.5% by mass of polyethylene terephthalate), thereby obtaining a spinning solution;

(2) electrospinning the spinning solution obtained in step (1) to obtain a fiber membrane loaded with the raw material of the magnetic material; the spinneret was connected to a voltage of +18 kV, the distance between the spinneret and the fiber receiver was 15 cm, and the spinning solution supply speed was 3 mL/h; during the spinning, the ambient temperature was 25° C., and the relative humidity was 65%;

(3) fully immersing the fiber membrane obtained in step (2) in a sodium hydroxide solution (with a pH value of 9, 9.2, 9.5 and 9.7, respectively) to make the aqueous solution carrying hydroxyl ions swell the fiber, and using the network composed of the polymer in the fiber as a microreactor to generate magnetic particles in situ in the fiber; and (4) after completion of the reaction, taking the fiber out of the sodium hydroxide solution, rinsing with deionized water to neutrality, and drying in air.

The transmission electron micrographs of the magnetic fiber prepared through the above scheme ("two-step method") are shown in FIG. 3(*b, d*); the size of the magnetic material aggregate in the fiber was about 10 nm (FIG. 3*b*), and there were bright spots in the Fourier transform result (FIG. 3*d*), indicating that the magnetic material had a regular structure in the fiber and was in an agglomerated state. In contrast, for the magnetic fiber prepared in Example 1, the internal magnetic material was completely in an amorphous state (as shown in FIGS. 3*a* and 3*c*), As indicated by the above results, the present invention uses the "one-step method" to react in one step during the fiber preparation process, thereby reducing the process steps and the agglomeration probability, and directly generating monomolecular dispersed magnetic particles. In contrast, the comparative technology ("two-step method") first prepares polymer fibers and then makes the fibers react in a reaction solution; due to the agglomeration of magnetic materials, monomolecular is dispersed magnetic particles cannot be generated.

The test results of the magnetic resonance relaxation rate of the magnetic fiber prepared by the above scheme ("two-step method") are shown in FIG. 4 (dotted circle); in the figure, the ordinate (the inverse ratio of the spin-lattice relaxation time $T_1$, $T_1$ Relaxation rate, $R_1$ for short) varied linearly with the abscissa (the concentration of particles in a unit amount of polymer). The relaxation rate $R_1$ is directly proportional to the magnetic resonance imaging signal intensity of the material; the larger the value is, the better the contrast effect will be. The measurement results in the figure show that, with the content of particles increased, the particles prepared by the technology of the present invention ("one-step method") achieved an increasingly better contrast effect due to their better dispersion, showing very obvious advantages. When the unit concentration of particles was about 0.032 $mmol \cdot g^{-1}$, the relaxation rate of the material prepared by the present invention ("one-step method") was more than 7 times that of the fiber obtained by the comparative technology ("two-step method"). This also shows that for the electrospinning technology, a new magnetic fiber with better magnetic properties can be produced by innovatively adopting the "one-step" technical solution in the reactive coagulation bath.

The reason why magnetic fibers with a higher relaxation rate can be prepared by the "one-step method" is that, for magnetic resonance, the coupling between paramagnetic materials and water molecules can significantly reduce the relaxation time of water molecules and increase the relaxation rate, and this property is used to prepare high-efficiency magnetic resonance contrast agents. According to the SBM theory (Solomon-Bloembergen-Morgan, see *ACS Appl. Mater Interfaces,* 2014, 6(16): 13730), the effective coupling between water molecules and paramagnetic materials requires that the distance between the nuclei of water molecules and magnetic materials should be sufficiently small. That is to say, for the agglomerated magnetic materials, the magnetic materials whose particles cannot be in direct contact with the external environment will not be able to couple with water molecules, resulting in their core particles not being able to effectively exhibit the relaxation effect.

The above examples are preferred embodiments of the present invention, but the embodiments of the present invention are not limited thereto, and any other alterations, modifications, replacements, combinations and simplifications made without departing from the spirit and principle of the present invention shall all be equivalent substitutions and included in the scope of protection of the present invention.

The invention claimed is:

1. A method for preparing magnetic fibrous materials, comprising:

(1) preparation of a spinning solution: comprising dissolving a polymer and a magnetic load raw material in a solvent to obtain a uniform spinning solution, wherein the polymer is at least one of the following substances: polyethylene terephthalate, polyvinyl alcohol, and polystyrene-polybutadiene-polystyrene block copolymer;

(2) preparation of a reactive coagulation bath solution comprising adding a solute component that reacts with the magnetic load raw material into a coagulation bath solvent to obtain a uniform reactive coagulation bath solution; and (3) electrospinning the uniform spinning solution obtained in step (1) to produce fiber, and collecting the produced fiber with the uniform reactive coagulation bath solution obtained in step (2), so that the magnetic load raw material in the fiber reacts in situ in situ with the solute in the uniform reactive coagulation bath solution to obtain the magnetic fibrous material.

2. The method for preparing magnetic fibrous materials according to claim 1, wherein a mass fraction of the polymer in the spinning solution is 1% to 40%.

3. The method for preparing magnetic fibrous materials according to claim 1, wherein the magnetic load raw material in step (1) is at least one of the chloride, oxide, nitrate and sulfate of iron, nickel, aluminum, manganese, copper and lanthanide metals; and the amount of the magnetic load raw material added is 0.001% to 10% by mass of that of the polymer.

4. The method for preparing magnetic fibrous materials according to claim 1, wherein the solvent in step (1) is one or a mixture of two or more of the following substances: water, dichloromethane, chloroform, dichloroethane, tetrachloroethane, methyl acrylate, tetrahydrofuran, methyltetrahydrofuran, N,N-dimethylformamide, N,N-dimethylacetamide, dimethyl sulfoxide, ether, petroleum ether, acetone, formic acid, acetic acid, trifluoroacetic acid, carbon tetrachloride, xylene, toluene, phenol, chlorobenzene, nitrobenzene, pentane, n-hexane, methylcyclohexane, N-methylpyrrolidone, anisole, methanol, ethanol, 1-propanol, 2-propanol, 1-butanol, 2-butanol, pentanol, N-methylmorpholine-N-oxide, methylimidazole chloride, and cresol.

5. The method for preparing magnetic fibrous materials according to claim 1, wherein the coagulation bath solvent in step (2) is one or a mixture of two or more of the following substances: water, dichloromethane, chloroform, dichloroethane, tetrachloroethane, methyl acrylate, tetrahydrofuran, methyltetrahydrofuran, N,N-dimethylformamide, N,N-dimethylacetamide, dimethyl sulfoxide, ether, petroleum ether, acetone, formic acid, acetic acid, trifluoroacetic acid, carbon tetrachloride, xylene, toluene, phenol, chlorobenzene, nitrobenzene, pentane, n-hexane, methylcyclohexane, N-methylpyrrolidone, anisole, methanol, ethanol, 1-propanol, 2-propanol, 1-butanol, 2-butanol, pentanol, N-methylmorpholine-N-oxide, methylimidazole chloride, and cresol.

6. The method for preparing magnetic fibrous materials according to claim 1, wherein the conditions for the electrospinning in step (3) are as follows: voltage of a spinneret is 0.5-50 kV, and voltage of the uniform reactive coagulation bath solution is 0-50 kV; a distance between the spinneret and the uniform reactive coagulation bath solution is 5-50 cm, and the uniform spinning solution supply speed is 0.1-30 mL/h; during the spinning, an ambient temperature is 5° C. to 60° C., and a relative humidity is 25% to 95%.

7. The method for preparing magnetic fibrous materials according to claim 1, wherein during the electrospinning in step (3), it is necessary to continuously supplement the uniform reactive coagulation bath solution to ensure the stability of its component ratio.

8. The method of preparing magnetic fibrous material according to claim 1, wherein the magnetic material is monodispersed in the fiber.

* * * * *